US008069993B2

(12) United States Patent
Yuyama et al.

(10) Patent No.: US 8,069,993 B2
(45) Date of Patent: Dec. 6, 2011

(54) MEDICINE CART

(75) Inventors: Shoji Yuyama, Osaka (JP); Masaaki Tomonaga, Osaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 212 days.

(21) Appl. No.: 11/665,285

(22) PCT Filed: Oct. 7, 2005

(86) PCT No.: PCT/JP2005/018617

§ 371 (c)(1),
(2), (4) Date: Apr. 13, 2007

(87) PCT Pub. No.: WO2006/041025

PCT Pub. Date: Apr. 20, 2006

(65) Prior Publication Data

US 2009/0045152 A1 Feb. 19, 2009

(30) Foreign Application Priority Data

Oct. 15, 2004 (JP) ..... 2004-301715

(51) Int. Cl.
*A47F 1/04* (2006.01)

(52) U.S. Cl. ..... 211/59.3

(58) Field of Classification Search ..... 211/59.2, 211/59.3, 74, 184; 312/35, 42, 45, 61, 71, 312/72, 73; 221/130, 56, 224–227, 279
See application file for complete search history.

(56) References Cited

U.S. PATENT DOCUMENTS 463,256 A * 11/1891 Side ..... 232/5
935,472 A * 9/1909 Demaine ..... 206/100
1,379,659 A * 5/1921 Talbot ..... 221/227
1,422,975 A * 7/1922 Holtzclaw ..... 221/227
1,638,181 A * 8/1927 Bell ..... 221/279
2,222,887 A * 11/1940 Willey ..... 221/279
2,287,005 A * 6/1942 Greaves ..... 211/184
2,305,348 A * 12/1942 King ..... 221/122
2,443,862 A * 6/1948 Justus ..... 221/279

(Continued)

FOREIGN PATENT DOCUMENTS

CH 412251 4/1966

(Continued)

OTHER PUBLICATIONS

U.S. Appl. No. 12/703,000, filed Feb. 9, 2010, Yuyama et al.

(Continued)

*Primary Examiner* — Darnell Jayne
*Assistant Examiner* — Joshua Rodden
(74) *Attorney, Agent, or Firm* — Patterson Thuente Christensen Pedersen, P.A.

(57) ABSTRACT

A medicine cart (1) having excellent workability in filling and returning a medicine, comprising an upwardly opening cassette (10) storing a plurality of medicines (15*a*, 15*b*, 15*c*) arranged in a row in an upright state and a pressing member (47) pressing the rearmost medicine (15*c*) in the cassette (10) forward. An insert guide part (51) is formed at the pressing side end part of the pressing member (47) so that the medicine (15) can be inserted between the pressing member (47) and the rearmost medicine (15*c*). The pressing side end part of the pressing member (47) having a vertical front surface and an inclined upper surface (51), wherein both the vertical front surface and the upper surface (51) are in the shape of a concave circular arc.

5 Claims, 10 Drawing Sheets

U.S. PATENT DOCUMENTS

| | | | | |
|---|---|---|---|---|
| 3,715,148 | A * | 2/1973 | Beals | 312/209 |
| 4,114,965 | A * | 9/1978 | Oye et al. | 312/209 |
| 4,303,162 | A * | 12/1981 | Suttles | 211/59.3 |
| 4,518,208 | A * | 5/1985 | Marder | 312/209 |
| 4,588,237 | A * | 5/1986 | Marder | 312/209 |
| 4,765,581 | A * | 8/1988 | Wallace et al. | 248/311.2 |
| 4,836,390 | A * | 6/1989 | Polvere | 211/59.3 |
| 5,067,780 | A * | 11/1991 | Rickard | 312/193 |
| 5,080,258 | A * | 1/1992 | Hinterreiter | 221/198 |
| D336,706 | S * | 6/1993 | Lechman et al. | D34/20 |
| 5,240,125 | A * | 8/1993 | Kunz | 211/59.3 |
| 5,240,126 | A * | 8/1993 | Foster et al. | 211/59.3 |
| 5,263,596 | A * | 11/1993 | Williams | 221/153 |
| 5,302,014 | A * | 4/1994 | Hobson | 312/249.12 |
| 5,351,839 | A * | 10/1994 | Beeler et al. | 211/59.3 |
| 5,533,799 | A * | 7/1996 | Nickolaus, Jr. | 312/249.12 |
| 5,791,516 | A * | 8/1998 | Wittern et al. | 221/301 |
| 5,873,489 | A * | 2/1999 | Ide et al. | 221/279 |
| 5,905,653 | A * | 5/1999 | Higham et al. | 700/244 |
| 6,011,999 | A * | 1/2000 | Holmes | 700/231 |
| 6,105,791 | A * | 8/2000 | Chalson et al. | 211/59.3 |
| 6,151,536 | A * | 11/2000 | Arnold et al. | 700/237 |
| 6,189,727 | B1 * | 2/2001 | Shoenfeld | 221/2 |
| 6,378,727 | B1 * | 4/2002 | Dupuis et al. | 221/92 |
| 6,415,950 | B1 | 7/2002 | Robrechts | |
| 6,464,089 | B1 * | 10/2002 | Rankin, VI | 211/59.3 |
| 6,523,703 | B1 * | 2/2003 | Robertson | 211/59.3 |
| 6,556,889 | B2 | 4/2003 | Rudick et al. | |
| 6,684,126 | B2 * | 1/2004 | Omura et al. | 700/231 |
| 6,866,156 | B2 * | 3/2005 | Nagel et al. | 211/59.3 |
| 6,886,699 | B2 * | 5/2005 | Johnson et al. | 211/59.3 |
| 6,915,923 | B1 * | 7/2005 | Magid | 221/56 |
| 6,996,455 | B2 * | 2/2006 | Eggenberger et al. | 700/231 |
| 7,086,650 | B2 | 8/2006 | Fujiwara et al. | |
| 7,140,499 | B2 * | 11/2006 | Burke | 211/59.3 |
| 7,168,579 | B2 * | 1/2007 | Richter et al. | 211/59.3 |
| 7,222,748 | B2 | 5/2007 | Holdway et al. | |
| 7,275,796 | B2 * | 10/2007 | Bochner et al. | 312/209 |
| 7,293,663 | B2 * | 11/2007 | Lavery, Jr. | 211/59.3 |
| 7,316,328 | B2 * | 1/2008 | Yuyama et al. | 221/227 |
| 7,344,050 | B2 | 3/2008 | Robrechts | |
| 7,451,891 | B2 | 11/2008 | Carter et al. | |
| 7,686,184 | B2 * | 3/2010 | Yuyama et al. | 221/210 |
| 2004/0065629 | A1 * | 4/2004 | Hunt et al. | 211/40 |
| 2004/0155051 | A1 * | 8/2004 | Magid | 221/59 |
| 2007/0221680 | A1 * | 9/2007 | Yuyama | 221/124 |
| 2007/0241122 | A1 * | 10/2007 | Yuyama et al. | 221/56 |
| 2007/0267364 | A1 * | 11/2007 | Barkdoll | 211/59.3 |
| 2009/0184069 | A1 * | 7/2009 | Hardy | 211/59.3 |

FOREIGN PATENT DOCUMENTS

| | | |
|---|---|---|
| JP | 62-136404 | 6/1987 |
| JP | 03-45766 | 4/1991 |
| JP | 03-083701 | 4/1991 |
| JP | 06-293402 | 10/1994 |
| JP | 07-215416 | 8/1995 |
| JP | 07-285613 | 10/1995 |
| JP | 10-334329 | 12/1998 |
| JP | 11-154266 | 6/1999 |
| JP | 2000-072204 | 3/2000 |
| JP | 2001-198194 | 7/2001 |
| JP | 2002-011073 | 1/2002 |
| JP | 2002-092725 | 3/2002 |
| JP | 2002-153540 | 5/2002 |
| JP | 2003-267520 | 9/2003 |

OTHER PUBLICATIONS

File wrapper for U.S. Appl. No. 12/703,000.
Japanese Office Action of JP2004-301715, dated Feb. 9, 2010.

* cited by examiner

MEDICINE CART

TECHNICAL FIELD OF THE INVENTION

The present invention relates to a medicine cart having a large number of cassettes each of which stores a plurality of medicines arranged in a row in an upright state, which are provided for their respective types of medicines, and is capable of taking out or returning medicines required at a hospital or the like one by one from the forefront and also capable of calculating the quantity of medicines taken out and controlling inventory thereof.

BACKGROUND OF RELATED ARTS

As this type of a medicine cart, patent document 1 proposes a medicine storage device, in which a cassette inclined with the take-out side thereof facing downward stores a plurality of medicines arranged in a row in the upright state, the medicines are biased forward by a weight that contacts with a rearmost medicine, and the medicines are taken out one by one from an entrance provided in the corner of the front end of the cassette or the medicine taken out is returned therefrom.

Patent Document 1: Japanese Unexamined Patent Publication No. 2001-198194

DISCLOSURE OF THE INVENTION

Problem to be solved by the Invention

However, with the medicine storage device of patent document 1, since only the entrance at the front end of the cassette opens, the weight first needs to be pressed away rearward and then the medicines needs to be shifted rearward one by one for storage, which requires troublesome medicine filling operation. To return the medicine taken out, the medicine to be returned is made in contact with the medicine at the forefront exposed to the entrance of the cassette and all the medicines are lifted up against the biasing force of the weight, whereby the medicine is pressed in the empty space, which raises problems such as poor workability at the time of returning the medicine.

In view of the problem described above, the present invention has been made and it is an object of the invention to provide a medicine cart having excellent workability at the time of filling and returning medicines. It is also an object of the invention to provide a medicine cart capable of preventing a medicine at the second position from the forefront from coming out when the medicine is to be taken out.

Means for Solving the Problem

To achieve the object described above, the present invention provides a medicine cart including an upwardly opening cassette that stores a plurality of medicines arranged in a row in an upright state and a pressing member that presses forward a rearmost medicine in the cassette, wherein, at the pressing side end part of the pressing member, an insert guide part is firmed so that the medicine can be inserted between the pressing member and the rearmost medicine.

With the means described above, the cassette opens upward, which permits easily filling the medicine from this wide opening. Moreover, by pressing the medicine taken out against the insert guide part, the medicine can be guided to the insert guide part and easily inserted between the pressing member and the rearmost medicine.

It is preferable that the insert guide part have a surface formed in a shape of a circular arc as viewed from a direction in which the medicine is inserted and that the circular arc shaped surface have a radius of curvature that is larger than the radius of the medicine.

It is preferable that the insert guide part be formed by notching the pressing member.

It is preferable that, in the cassette, a coming-out preventing member be provided which covers the upper portion of a head part or shoulder part of the medicine at the second position from the forefront. Consequently, upon taking out the medicine at the forefront, even when the medicine at the second position also lifts up due to friction, this is prevented by the coming-out preventing member.

Effects of the Invention

According to the present invention, at the pressing side end part of the pressing member, an insert guide part is provided so that the medicine can be inserted between the pressing member and the rearmost medicine, thereby permitting easily filling the medicine from a wide opening. Moreover, only by pressing a medicine taken out against the insert guide part, the medicine taken out can be easily inserted, thereby improving workability at the time of filling and returning the medicine.

A coming-out preventing member is provided which covers an upper portion of a head part or shoulder part of a medicine at the second position from the forefront. Consequently, upon taking out the forefront medicine, the medicine at the second position can be prevented from coming out, thereby permitting reliably taking out the medicines one by one.

PREFERRED EMBODIMENTS OF THE INVENTION

Hereinafter, an embodiment of the present invention will be described, with reference to the accompanying drawings.

Figure 1:
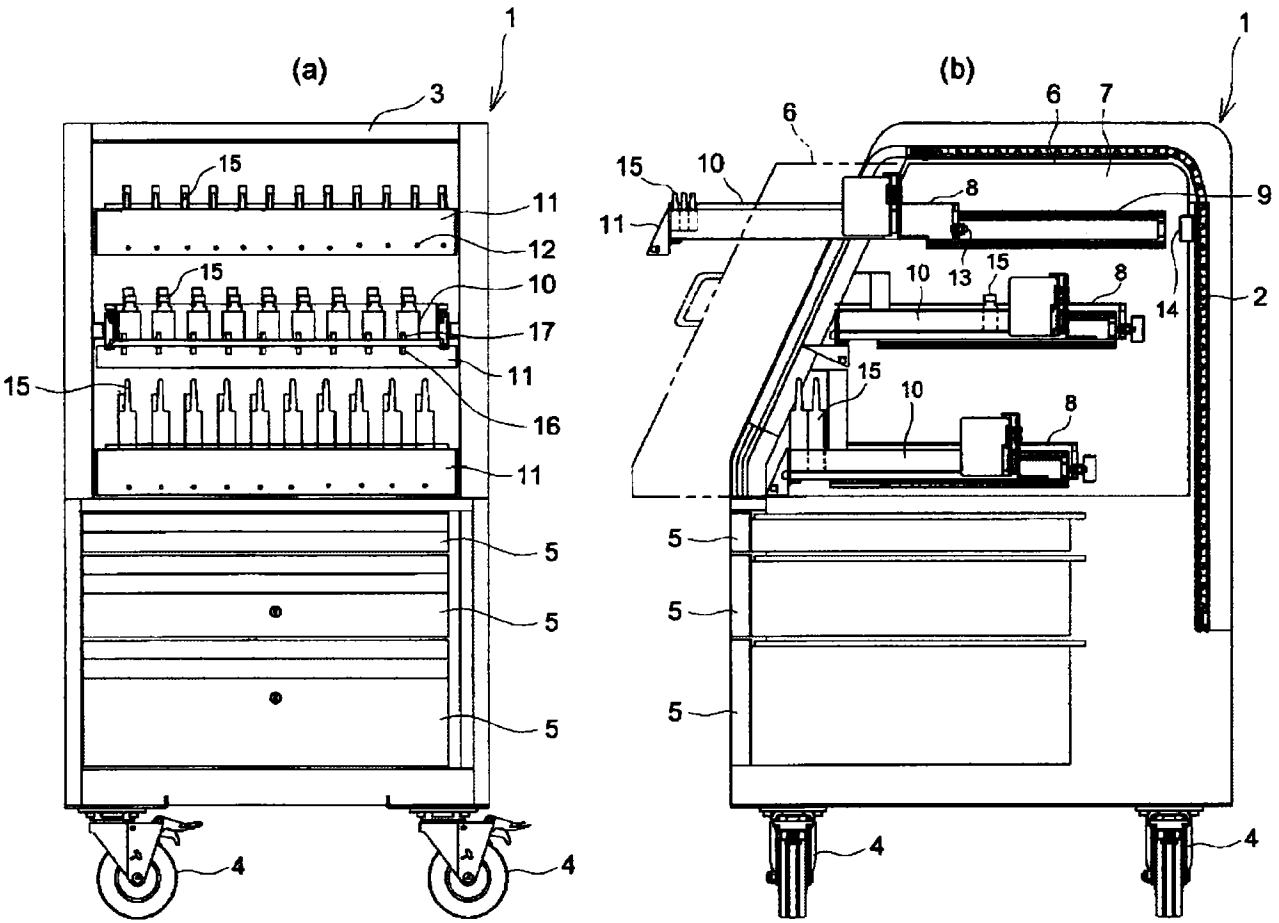
FIG. 1A is an elevation view of a medicine cart according to the present invention.
FIG. 1B is a side sectional view of FIG. 1A.
Figure 2:
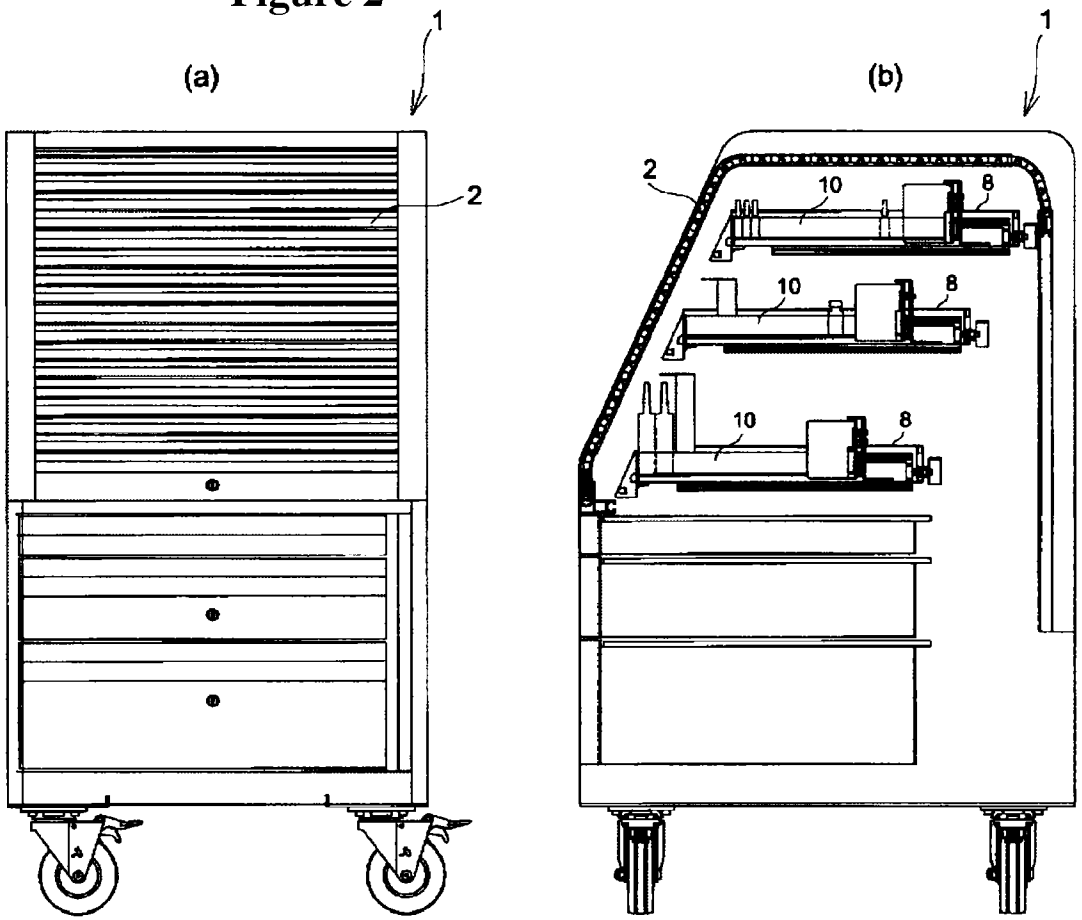
FIG. 2A is an elevation view of the medicine cart of FIG. 1 with a shutter closed.
FIG. 2B is a side sectional view of FIG. 2A.

FIG. 1 is an elevation view and a side sectional view of a medicine cart 1 according to the present invention, and FIG. 2 is an elevation view and a side sectional view of the medicine cart 1 of FIG. 1 with a shutter 2 thereof closed.

The medicine cart 1 has a main body 3 formed in a box-like shape and having a front surface thereof open. The lower half part of the front surface of the main body 3 is oriented perpendicularly, and the upper half part thereof is inclined rearward. On the bottom surface of the main body 3, four casters 4 are provided so that the medicine cart 1 is movable. To the lower half part of the main body 3, three drawer bodies 5 are so provided vertically as to be drawable forward. In these drawer bodies 5, different types of supplies are stored. The opening in the front surface of the upper half part of the main body 3 is closable by the shutter 2 as shown in FIG. 2. To the upper half part of this main body 3, a drawing rack 6 is so provided as to be drawable forward.

Figure 4:
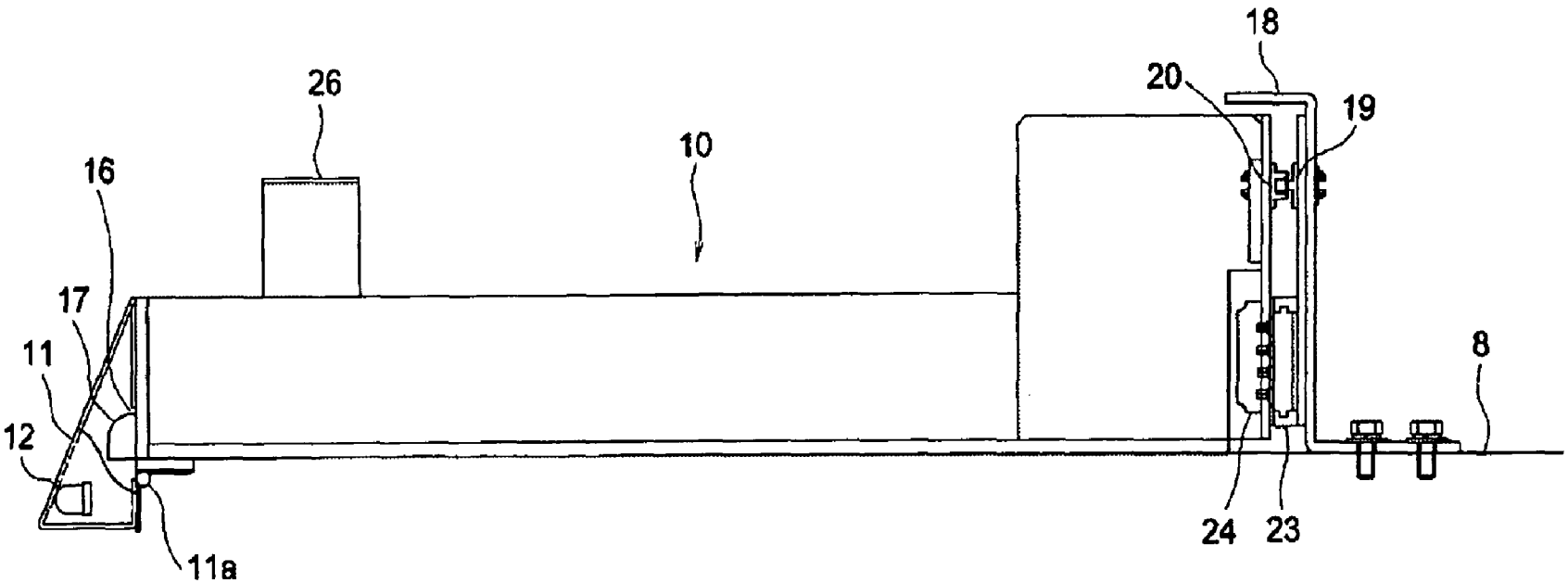
FIG. 4 is a side view of the cassette.
Figure 5:
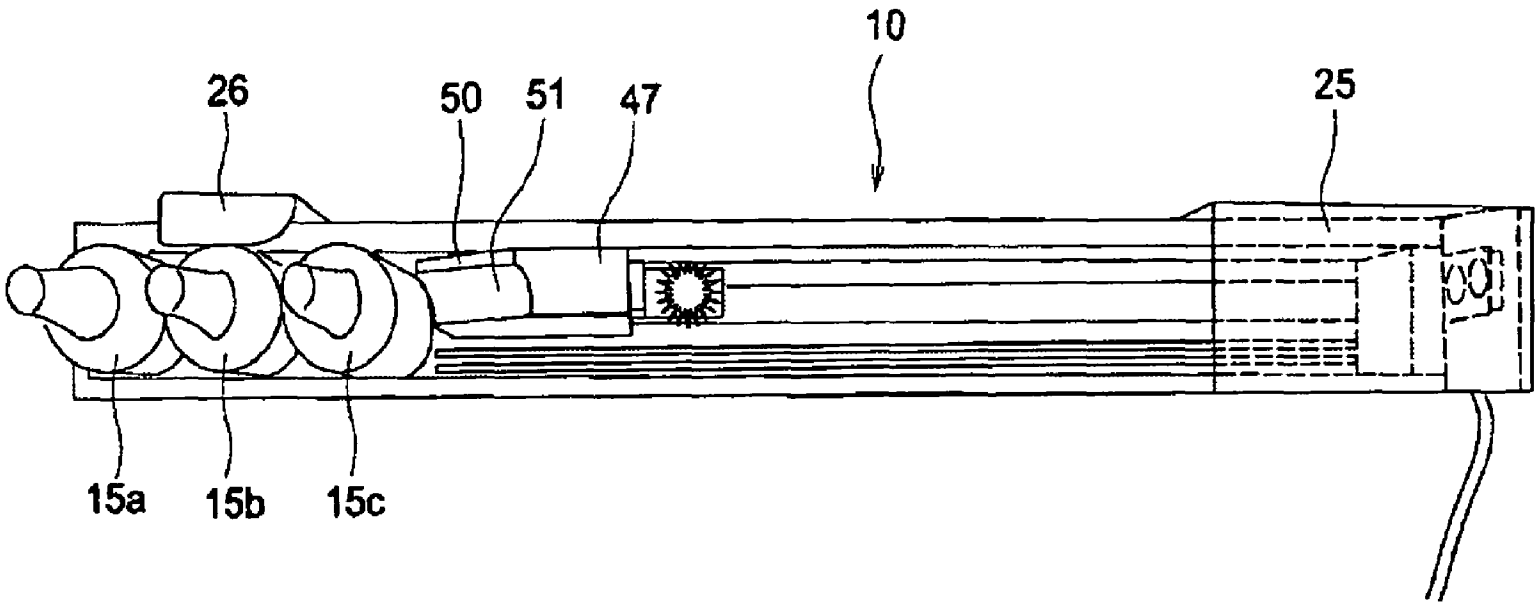
FIG. 5 is a diagram of the cassette as viewed from the above.

The aforementioned drawing rack 6 is composed of side plates 7 on the right and left sides and shelf plates 8 provided vertically in three levels. Each shelf plate 8 is so supported as to be drawable forward along a slide rail 9 provided on the side plate 7 on the right and left sides. The front ends of the shelf plates 8 provided vertically in three levels are arranged in a step-like manner so that the one in the first level is located forward of the second and third levels while those in the second and third levels are shifted rearward and at an upward position from the second to the third levels. On the top surfaces of the shelf plates 8, a plurality of cassettes 10 are arranged respectively. To the front end of each shelf plate 8, as shown in FIG. 4, a front panel 11 is so fitted as to be turnable about a spindle 11*a* between the upright position (see the cassettes 10 in the first and third levels of FIG. 1B) and the horizontal position (see the cassette 10 in the second level of FIG. 1B). To the front panel 11, an LED12 is provided at a position facing the cassette 10. To the rear end of each shelf plate 8, a catch 13 is provided, which engages with a catch receiver 14 provided to the side plate 7 when the shelf plate 8 is pressed in to thereby prevent the shelf plate 8 from improperly dropping out due to shock or the like.

The respective cassettes 10 of the shelf plates 8 store different types of medicines (ampoules in this embodiment) 15 and thus have different sizes depending on the medicines 15 to be stored, although their basic structure are the same. Hereinafter, a description will be given, referring to any one of the cassettes 10.

Figure 3:
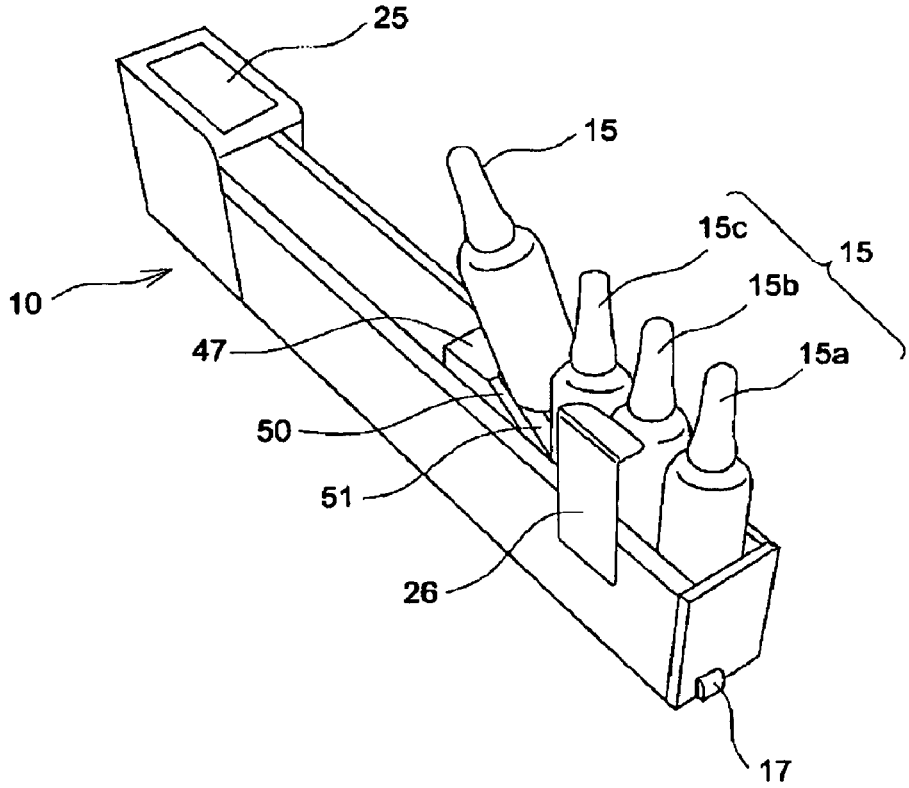
FIG. 3 is a perspective view of a cassette.
Figure 6:
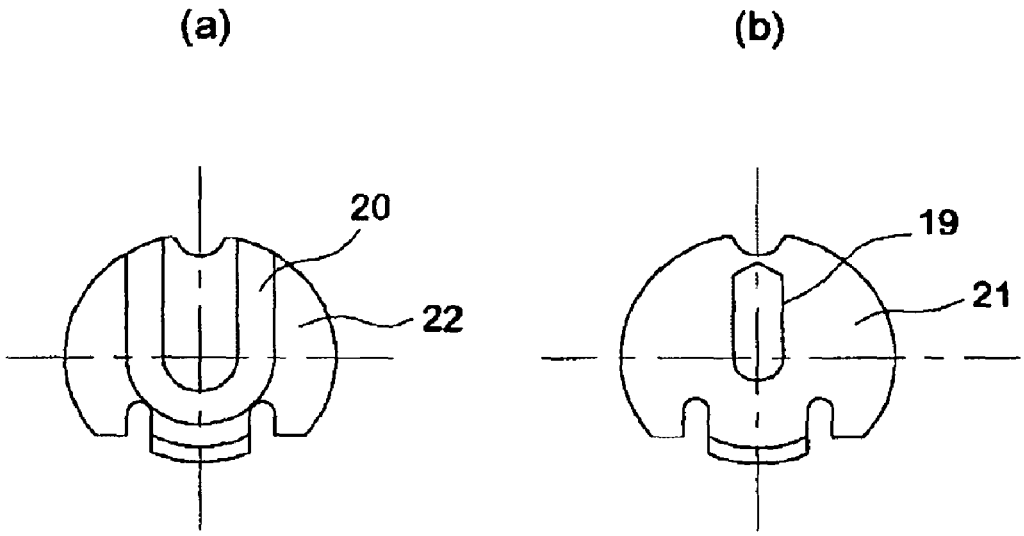
FIG. 6A is an elevation view of a pin receiver of the cassette.
FIG. 6B is an elevation view of a pin of the cassette.

The cassette 10 has an anteroposteriorly long box shape with the upper side thereof opening and is capable of storing the medicines 15 arranged in a row, as shown in FIG. 3. The rear portion of the cassette 10 is formed higher than the full portion thereof. On the front end surface of the cassette 10, as shown in FIG. 4, a projection 17 is formed which engages with a hole 16 provided in the rear surface of the front panel 11. On the rear end surface of the cassette 10, a pin receiver 20 is provided which engages with a pin 19 of a cassette fitting stay 18 vertically provided to the shelf plate 8. The pin 19 has, as shown in FIG. 6B, an oval cross section with a base 21 thereof provided at a position biased from the fitting center. The pin receiver 20 has, as shown in FIG. 6A, a U-shaped cross section with a base 22 thereof provided at a position biased from the fitting center. The pin 19 and the pin receiver 21 can be fitted in ten levels at a fitting angle of 36 degrees, so that improper fitting can be prevented by fitting each cassette 10 at a different angle. The pin 19 and the pin receiver 20 can be provided not only in one pair, but also in two or more pairs. On the rear end of the cassette 10 below the pin receiver 20, a cassette side connector 24 is provided which is electrically connected to a shelf side connector 23 provided to the cassette fitting stay 18. The top surface of the rear portion of the cassette 10 is covered by a transparent cover 25, on which the name and a photo of the medicine to be stored in this cassette 10 are displayed. To the side surface of the front portion of the cassette 10, a coming-out preventing member 26 is fitted which is formed in the shape of an inverted L and which covers the upper portion including from the medicine 15*a* at the forefront to the shoulder part (if there is no shoulder part, a head part may be applied) of the medicine 15*b* at the second position that are both stored in the cassette 10.

Figure 7:
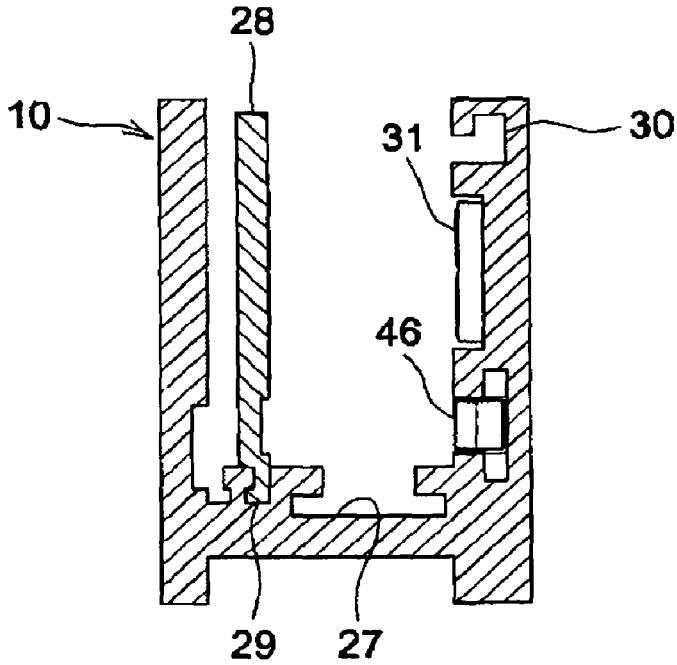
FIG. 7 is a sectional view of the cassette.
Figure 10:
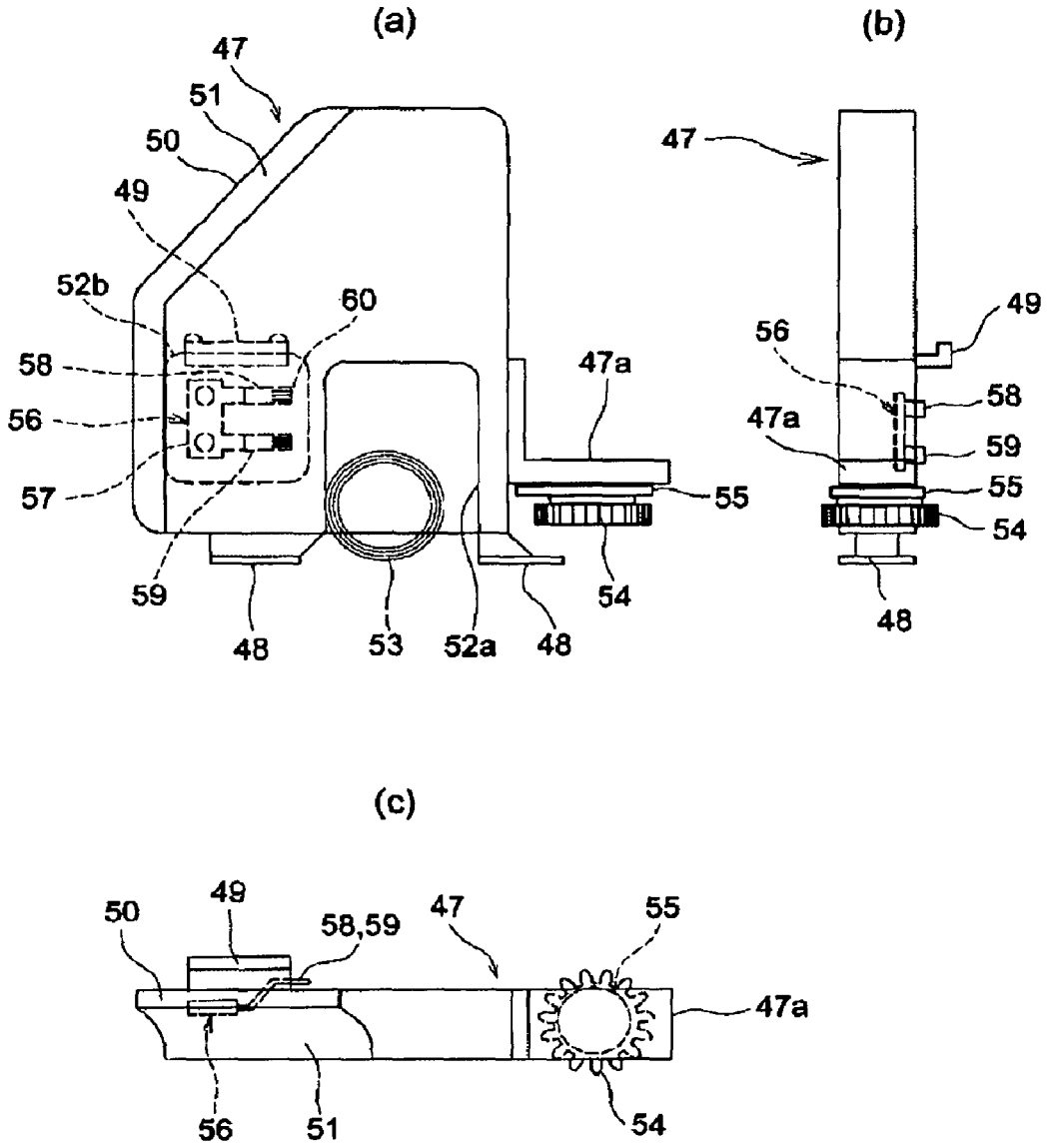
FIG. 10A is a sectional view of a pressing member.
FIG. 10B is a back view of the pressing member of FIG. 10A.
FIG. 10C is a plan view of the pressing member of FIG. 10A.

On the inner bottom surface of the cassette 10, as shown in FIG. 7, there are formed: a slide groove 27 on which a band plate of a constant force spring 54 of FIG. 10 to be described below is disposed and with which a pressing member 47 slidably engages; and a spacer fitting groove 29 which is fitted with a spacer 28 for adjusting the inner width of the cassette 10 in accordance with the size of the medicine 15. On the inner side surface of the cassette 10, a vibration-preventing rail 30 is formed with which a vibration-preventing boss 49 of the pressing member 47 engages. Below the vibration-preventing rail 30, a slide resistance unit 31 and a rack gear 46 are so fitted as to extend anteropoteriorly.

Figure 8:
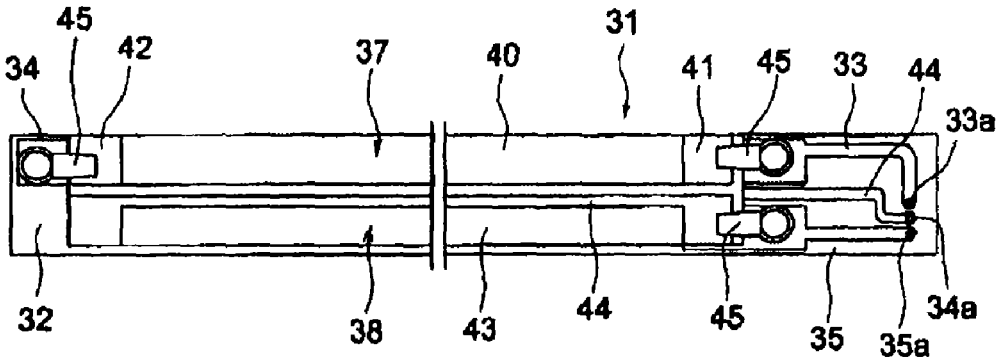
FIG. 8 is a plan view of a slide resistance unit.
Figure 9:
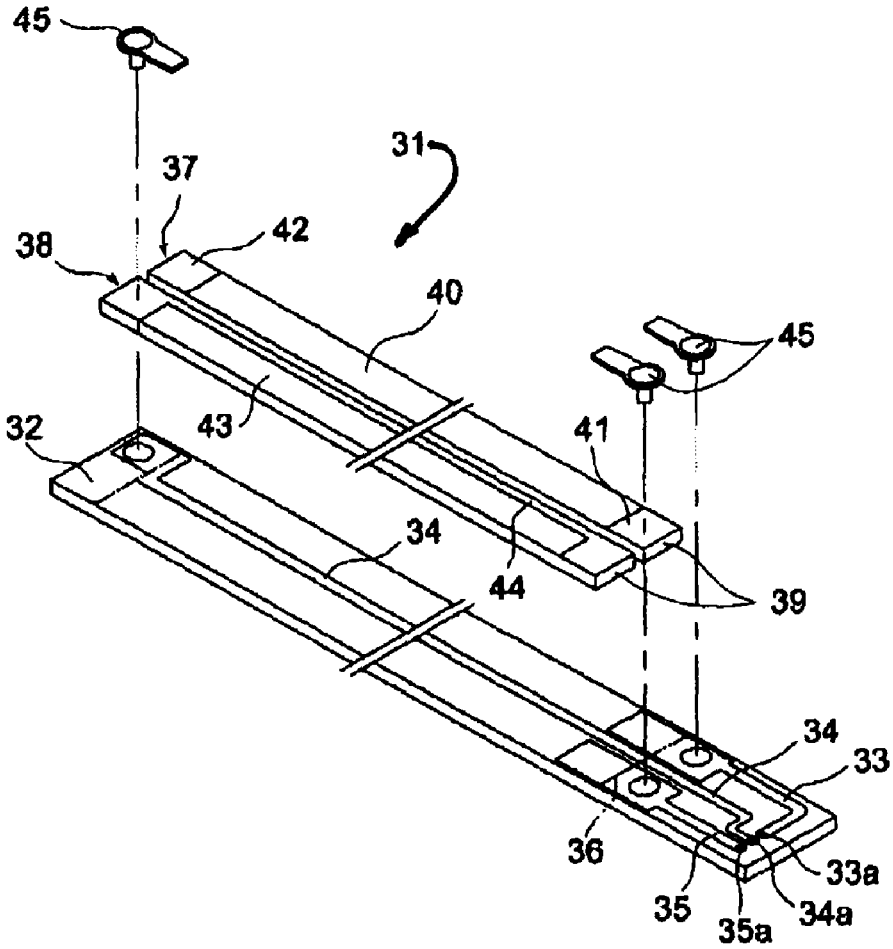
FIG. 9 is an exploded perspective view of the slide resistance unit of FIG. 8.
Figure 12:
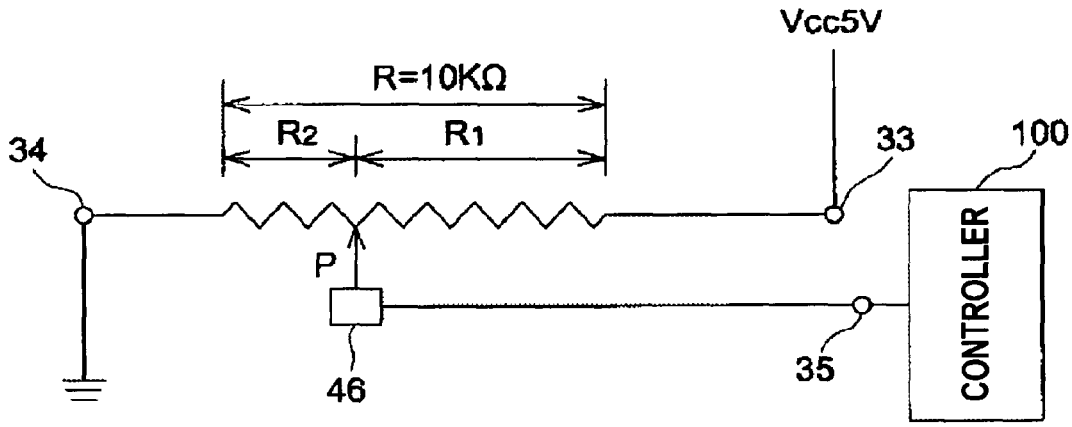
FIG. 12 is a circuit diagram of a measuring device employing the slide resistance unit.

The slide resistance unit 31, as shown in FIGS. 8 and 9, has an insulating substrate 32 which is formed in an elongated rectangular shape and on one end of which a positive side conductive pattern 33, a negative side conductive pattern 34, and a detection side conductive pattern 35 are disposed. The negative side conductive pattern 34 extends to the other end of the substrate 32. On the conductive patterns 33, 34, and 35 of the substrate 32, two elongated first and second slide resistance plates 37 and 38 are attached in parallel by a two-sided tape 36. The first slide resistance plate 37 has a resistive paste 40 exposed on a MYLAR film 39 with silver pastes 41 and 42 further exposed on both ends thereof. The resistive paste 40 between the silver pastes 41 and 42 has a resistance of 10Ω. Similarly, the second slide resistance plate 38 has a resistive paste 43 exposed on the MYLAR film 39 with a silver paste 44 exposed on the one end portion to the other end portion through one of side edge portions. The silver paste 41 at one end of the first slide resistance plate 37 is connected to the positive side conductive pattern 33 via a metal fitting 45, and the silver paste 42 at the other end thereof is connected to the negative side conductive pattern 34 via the metal fitting 45. The silver paste 44 of the second slide resistance plate 38 is connected to the detection side conductive pattern 35 via a metal fitting 45. The positive side conductive pattern 33 of this slide resistance unit 31 is connected, as shown in FIG. 12, to a Vcc terminal 5V having a constant-voltage power supply. The negative side conductive pattern 34 is ground. The detection side conductive pattern 35 is connected to a detection terminal of a controller 100.

Figure 11:
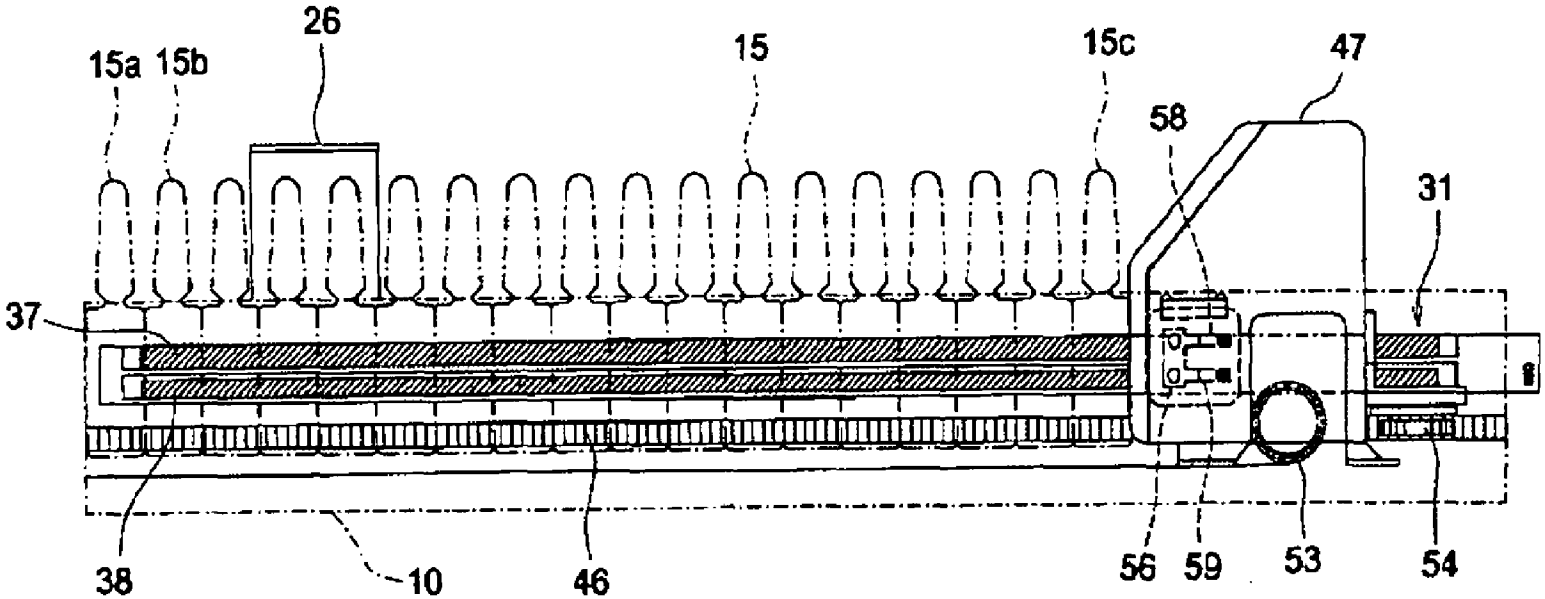
FIG. 11 is a longitudinal sectional view of the cassette.

The medicine 15 stored and arranged in a row in the cassette 10 is pressed forward by the pressing member 47. The pressing member 46 is, as shown in FIG. 10, formed in the shape of a rectangular plate, on the bottom surface of which an engaging projection 48 for engaging with the slide groove 27 of the aforementioned cassette 10 is formed and on the side surface of which the vibration-preventing boss 49 for engaging with the vibration-preventing rail 30 of the cassette 10 is formed. The upper corner at the front end of the pressing member 47 is cut diagonally, forming an inclined surface 50. On this inclined surface 50, an insert guide part or portion 51 is formed which is made of a surface formed in the shape of a circular arc as viewed from the direction in which the medicine is inserted. The angle of the inclined surface 50 is set so that the medicine 15 makes contact with the insert guide part 51 without fail when inserted from the above. The circular arc shaped surface of the insert guide part 51 has a radius of curvature larger than the radius of the medicine 15. The insert guide part 51 continues to the front end surface of the pressing member 47. On the bottom of the pressing member 47, a depression 52*a* is formed which stores a constant force spring 53. The constant force spring 53 is composed of a long band plate wound around. When its leading end is pulled out, it is restored with a certain magnitude of force; therefore, Conston (Registered trademark) or the like that is commercially available is used. The band plate of the constant force spring 53 is, as shown in FIG. 11, disposed along the slide groove 27 of the cassette 10, with the leading end thereof fixed to the front end of cassette 10. To a projection 47*a* formed in the shape of an L and provided on the rear end surface of the pressing member 47, there are provided: a pinion gear 54 which engages with the rack gear 46 of the aforementioned cassette 10 and an oil damper 55 which is coupled with the pinion gear 54. Load is imposed on the pinion gear 54 during rotation under the action of the oil damper 55. This permits preventing occurrence of problems such as that the pressing member 47 suddenly moves to hit the stored medicine 15 under influence of a biasing force of the constant force spring 53.

Below the vibration-preventing boss 49 on the side surface of the pressing member 47, a depression 52*b* is formed, to which a pair of brushes 56 are fitted which makes sliding contact with the aforementioned slide resistance unit 31. This brush 56 is composed of: a base 57 formed of a plate-like electric conductor; and sliding parts 58 and 59 of conductive and elastic bodies fitted to the base 57 in parallel to each other. This brush 56 is designed such that fitting the base 57 to the pressing member 47 as shown in FIG. 11 causes the leading end portions of the sliding parts 58 and 59 to slidably make pressure contact with the first and second slide resistance plates 37 and 38 of the slide resistance unit 31. The sliding parts 58 and 59 each have a notch 60 formed on the leading ends thereof so as to make contact evenly with the slide resistance plates 37 and 38 even when inclined to some degree.

In the medicine cart 1 structured as described above, to store the medicine 15, the front panel 11 is opened to take out the cassette 10 from the shelf plate 8, the pressing member 47 is moved rearward, and a given number of medicines 15 are stored between the pressing member 47 and the front end of the cassette 10. The medicines 15 are pressed forward by the pressing member 47.

When the cassette 3 is fitted to the shelf plate 8, the cassette side connector 24 and the shelf side connector 23 electrically contact with each other, whereby a voltage is supplied from the shelf plate 8 side to the slide resistance unit 31 of the cassette 10. The brush 56 of the pressing member 47 slides on the first and second slide resistance plates 37 and 38, and stops at a position in accordance with the quantity of the medicines 15. Where the stop position of the brush 56 is P, as shown in FIG. 12, a partial pressure of $Vp=R2/R$ is inputted to the controller 100 via the brush 56 located at the P position. The controller 100 reads out voltage or processing conditions stored in a storage device, and a processor calculates the quantity of medicines corresponding to the detected voltage and outputs the results as the current quantity of medicines.

Based on prescription information transmitted from a host computer when the medicine cart 1 is connected to the host computer, or based on prescription information inputted with a bar code reader or a keyboard when the medicine cart 1 is stand alone, the LED12 of the front panel 11, which corresponds to the cassette 10 storing the medicines 15 required for prescription, lights up or blinks. Note that the LED12 also lights up or blinks when the medicines 15 are missing.

The medicine 15 may be taken out by holding and lifting upward the medicine 15*a*, at the forefront, of the cassette 10. In this operation, the medicine 15*b* at the second position may come out together with the medicine 15*a* at the forefront due to friction, but the medicine 15*b* at the second position hits the coming-out preventing member 26 to be thereby prevented from coming out. When the medicine 15*a* at the forefront is taken out, the row of the medicines 15 is pressed forward by the pressing member 47, so that the medicine 15*b* located at the second position is placed at the forefront. In this manner, the required quantity of medicines 15 can be taken out sequentially. The shelf plates 8 provided vertically in three levels are arranged in the step-like manner so that they are shifted more rearward at more upward position from the first, the second, to the third levels. Thus, when the medicine 15 is to be taken out from the cassette 10 of the shelf plate 8 located at the first level at the bottom, the shelf plate 8 at the second level does not get in the way.

When a wrong medicine 15*a* is taken out or when an extra medicine 15*a* is taken out, this medicine 15*a* needs to be returned to the cassette 10. In this case, as shown in FIG. 3, by pressing the bottom of the medicine 15 along the insert guide part 51 of the pressing member 47, the medicine 15 is inserted between the medicine 15*c* at the rearmost and the pressing member 47 to be thereby located at the rearmost.

In this manner, the aforementioned medicine cart 1 is capable of reliably taking out the medicines 15 one by one and also capable of easily returning the medicine 15*a* once taken out to the cassette 10, thereby providing the excellent workability at the time of filling and returning the medicine 15.

When the medicine cart 1 is not in use, the shutter 2 can be closed so that an unauthorized third party cannot take out the medicine 15, which provides safety. Moreover, it is preferable that the medicine cart 1 be powered off by closing the shutter 2.

In the aforementioned embodiment, a display panel may be provided to the top surface of the main body of the medicine cart 1 so that an image, a name, and the quantity of the medicines 15 taken out can be displayed on the display panel to thereby permit comparison between the medicine taken out and the display on the display panel.

REFERENCE NUMERALS

1. Medicine cart
10. Cassette
15. Medicine
26. Coming-out preventing member
47. Pressing member
51. Insert guide part

The invention claimed is:

1. A medicine cart comprising:

a cassette being upwardly open along substantially the entire length of the cassette, wherein the cassette is adapted to store a plurality of ampoules arranged in a row in an upright state;

a pressing member adapted to press forward a rearmost ampoule of the plurality of ampoules in the cassette; and a constant force spring adapted to bias the pressing member to the rearmost ampoule, wherein the pressing member includes:

a vertical, front end surface contacting the rearmost ampoule; and an insert guide portion extending from the front end surface, the insert guide portion diagonally inclined relative to the front end surface, the medicine cart being configured for open access of the insert guide portion from above, and wherein the insert guide portion comprises a diagonally inclined surface relative to the front end surface, the diagonally inclined surface being formed in a shape of a concave circular arc which is concave with respect to the rearmost ampoule when viewed from a direction in which the ampoule is inserted so that the ampoule can be inserted between the pressing member and the rearmost ampoule along the insert guide portion, the concave circular arc having a radius of curvature larger than a radius of the ampoule.

2. The medicine cart according to claim 1, wherein the insert guide portion is formed by notching the pressing member.

3. The medicine cart according to claim 1, wherein, in the cassette, a coming-out preventing member is adapted to cover an upper portion of a head or shoulder of the ampoule at a second position from a forefront.

4. The medicine cart according to claim 2, wherein, in the cassette, a coming-out preventing member is configured to cover an upper portion of a head or a shoulder of the ampoule at a second position from a forefront.

5. A medicine cart comprising:

an elongate upwardly open cassette adapted to receive, store, and dispense a plurality of medicine containers arranged in a row in an upright state, the medicine containers each having a body portion having a radius of curvature, the cassette having a front end, a rear end, and an upwardly oriented opening extending substantially the entire length of the cassette for receiving the medicine containers from above, the cassette further comprising a pressing member slidingly engaged with the cassette in the opening and biased forwardly for pressing forward a rearmost medicine container of the plurality of medicine containers in the cassette, the pressing member defining an insert guide portion for receiving medicine containers between the pressing member and the rearwardly most medicine container in the row, the pressing member configured to slide rearwardly upon insertion of the rearwardly most medicine container in the row, the insert guide portion having an inclined upper surface and a vertical lower front end surface, the inclined upper surface diagonally positioned with respect to the lower front end surface, the inclined upper surface and the lower front end surface each having a concave arc shaped surface sized to have a radius of curvature larger than a radius of the medicine container.

* * * * *